United States Patent [19]

Gaisser

[11] Patent Number: 5,066,532

[45] Date of Patent: Nov. 19, 1991

[54] WOVEN MULTILAYER PAPERMAKING FABRIC HAVING INCREASED STABILITY AND PERMEABILITY AND METHOD

[75] Inventor: Hermann Gaisser, Schlaitdorf, Fed. Rep. of Germany

[73] Assignee: Hermann Wangner GmbH & Co., Reutlingen, Fed. Rep. of Germany

[21] Appl. No.: 74,339

[22] Filed: Jul. 16, 1987

Related U.S. Application Data

[63] Continuation-in-part of Ser. No. 763,039, Aug. 5, 1985.

[51] Int. Cl.[5] ..... B32B 3/00; B32B 3/10; D03D 1/00; D03D 3/04; D21F 7/08

[52] U.S. Cl. ..... 428/137; 139/383 A; 162/DIG. 1; 428/161; 428/196; 428/255; 428/257; 428/258; 428/259

[58] Field of Search ..... 428/137, 161, 196, 255, 428/257, 258, 259; 162/DIG. 1; 139/383 A

[56] References Cited

U.S. PATENT DOCUMENTS

| | | | |
|---|---|---|---|
| 2,157,082 | 5/1939 | Milnes | 139/383 A |
| 3,049,153 | 8/1962 | Jones | 139/383 A |
| 3,815,645 | 6/1974 | Codorniu | 139/383 |
| 4,086,941 | 5/1978 | Thompson | 139/387 |
| 4,528,239 | 7/1985 | Trokham . | |

FOREIGN PATENT DOCUMENTS

| | | |
|---|---|---|
| 0059973 | 9/1982 | European Pat. Off. . |
| AS1560182 | 5/1970 | Fed. Rep. of Germany . |

OTHER PUBLICATIONS

"Hydropress" advertising flyer—1 sheet Exact date unknown, but prior art.

"Geschmay Information" brochure—FIGS. 5-7 and description—exact date unknown, but prior art.

*Primary Examiner*—James C. Cannon

*Attorney, Agent, or Firm*—Cort Flint

[57] ABSTRACT

A papermaking fabric and method therefor is disclosed which may be used as a support fabric or a carrier fabric for paper material on a papermaking machine. The fabric, designated generally as (A) includes a first layer (B) of longitudinal yarns (32, 34, 36, and 38) extending in a machine direction. A second layer (C) of longitudinal yarns (42, 44, 46, and 48) is included in the fabric vertically spaced from the first layer. The longitudinal yarns of the first and second layer form stacked pairs (52, 54, 56, and 58) which reinforce the fabric in a machine direction to enhance its stability. At the same time, the stacked pairs may be spaced apart in a cross-machine direction sufficiently to provide a desired degree of openness and fabric permeability. Fabric openness in the range of thirty percent or more of the total fabric area can be had in accordance with the fabric of the present invention without sacrificing the structural stability. A single transverse yarn system (40) is interwoven with the first and second longitudinal layers (B and C) in a balanced weave pattern that maintains the longitudinal yarns of the respective layers stacked. The balanced weave pattern of the transverse yarn in the cross-machine direction resists lateral shifting of the stacked longitudinal yarns to prevent them from becoming side-by-side. In a preferred embodiment, the fabric is utilized as a base fabric for a resinous layer 62 which supports the paper and has an embossed surface 64 which makes a corresponding pattern in the paper, such as in towel grade paper.

9 Claims, 2 Drawing Sheets

WOVEN MULTILAYER PAPERMAKING FABRIC HAVING INCREASED STABILITY AND PERMEABILITY AND METHOD

This is a continuation-in-part of copending application Ser. No. 763,039 filed on Aug. 5, 1985.

BACKGROUND OF THE INVENTION

The invention relates to woven permeable fabric which supports paper stock during the manufacture of paper on a papermaking machine. In particular, the invention is directed to a multilayer fabric having increased structural stability in a machine direction in which the fabric travels on the papermaking machine while still affording a high degree of permeability which facilitates drying of the paper. The fabric of the invention has application as a support fabric for directly supporting a paper web on a papermaking machine. The fabric has further application as a carrier fabric for carrying a layer of material which contacts the paper instead of the paper contacting the fabric directly. A carrier fabric is typically utilized in the manufacture of embossed paper products as a base fabric. In such an application, a layer of material is embedded in or carried on the base fabric which is embossed to imprint a desired pattern on the paper sheet contacted by the embossed layer. The load in the machine direction is carried mainly by the base fabric and not the embossed layer. For drying purposes, the carrier fabric must have a high degree of openness and air permeability so that sufficient air is delivered through the base fabric and the embossed layer, which is also permeable for drying. Carrier fabric must have sufficient load bearing capability for bearing the loads in the machine direction which are most severe.

Heretofore, single layer fabrics have been utilized as carrier and support fabrics which have one warp system and one weft system. In order for a single layer of fabric to have an open area above thirty percent the machine direction yarns become spread apart to such an extent that fabric stability in the machine direction becomes too low. In order to achieve desired projected open areas above thirty percent a single layer fabric must be made of thin warp and weft yarns (e.g. 0.10 to 0.20 mm diameter). The single layer fabrics have utilized low warp and weft counts per centimeter, for example, 20 ends or picks per centimeter. Under these conditions, the single layer fabric tends to stretch unacceptably while traveling in the machine direction. If additional machine direction yarns are utilized in order to strengthen the fabric, the open area of the fabric is reduced resulting in the permeability of the fabric being below desired levels.

A single layer fabric is disclosed in U.S. Pat. No 4,281,688 having a plurality of dominating floats on opposing faces of the fabric. Every alternating weft has a long knuckle to one face, and every other weft has a long knuckle to the opposite face. The projected open area of the fabric is limited.

U.S. Pat. No. 4,314,589 discloses a double layer fabric having two weft layers and a single warp layer. The warps lie next to each other almost without any spacing between adjacent warps providing little or no projected open area. U.S. Pat. No. 4,359,069 discloses a double layer fabric having a single warp yarn system extending in the machine direction and a double layer weft yarn system in the cross-machine direction. The yarns of the single layer warp system are spaced apart from one another with a yarn density of 0.50 to 0.65. This warp density in the machine direction cannot be lowered, as otherwise the fabric stability would drop too much. This provides a projected open area of only 13 to 25 percent of the total fabric area. The warp yarns in the machine direction have to bear the load when the fabric runs on the papermaking machine. U.S. Pat. No. 4,359,069 teaches recessing the single layer warp system which extends in the machine direction between the two layers of the weft yarn so the warp yarns are removed from wear, it is thought that this will enable the warp yarns to better withstand the longitudinal stresses and provide a longer fabric life. U.S. Pat. No. 4,344,465 discloses a double layer forming fabric having two function sides. However, there is only one layer of load bearing machine direction yarns. There are machine direction yarns on the paper support side of the fabric which do not bear loads.

International Publication No. (PCT) WO 80/01086, U.S. Pat. No. 4,356,225, and European Patent Application No. EP 0 123 431 A2, describe multilayer wet felt designs. The technology for weaving multilayered fabrics for felt bases was begun primarily to increase void volume under pressure. These press felt base fabrics are preferably woven endless. Due to the quite different objectives in designing these fabrics none of these described designs show a structurally stable weave pattern and a projected open area in the range of thirty percent or more as in the case of the present invention.

European Patent Application No. EP 0 135 231 A1 discloses a single layer flat carrier fabric used as a carrier of an embossed layer which imprints paper.

Thus, it can be seen that the prior single layer and multilayer fabrics are limited in their capacity to provide both high degrees of projected open area and structural stability in the machine direction.

Accordingly, an important object of the present invention is to provide a method and fabric with improved fabric stability in the machine direction while maintaining a projected open fabric area which facilitates use of the fabric as a support or carrier fabric on papermaking machines.

Still another important object of the present invention is to provide a woven multilayered papermaking fabric having an increased number of load bearing longitudinal yarns, i.e. yarns extending in a machine direction while maintaining a sufficient distance between adjacent longitudinal yarns to allow for a projected open area of at least thirty percent of the total fabric area.

Still another important object of the present invention is to provide a highly permeable woven fabric for use on paper machines and the like and method therefor wherein the load bearing machine direction yarns are doubled in their density without a decrease in the projected open area of the fabric.

Yet another important object of the present invention is to provide a woven multilayered papermaking fabric having a first layer and a second layer of longitudinal yarns, which are interwoven with a single transverse yarn system which maintains the longitudinal yarns of the first and second layers in stacked pairs which may be spaced apart sufficiently to provide a desired open area in the fabric.

SUMMARY OF THE INVENTION

A highly permeable woven multilayer papermaking fabric having increased fabric stability in a machine direction and method therefor is disclosed. The fabric includes a paper support side and a roller contact side facilitating travel as an endless belt in the machine direction. The fabric comprises a first longitudinal yarn layer of first load bearing longitudinal or machine direction yarns on the paper support side of the fabric, and a second layer of second load bearing longitudinal or machine direction yarns on the roller contact side of the fabric. Stacked longitudinal yarn pairs are defined by respective ones of the first and second longitudinal yarns of the first and second longitudinal yarn layers arranged in a superposed position one over the other. The stacked longitudinal yarn pairs are spaced apart next adjacent one another in a cross-machine direction in the fabric to provide a desired fabric open area. A longitudinal yarn balancing transverse yarn is interwoven with the first and second longitudinal yarn layers to bind the first and second longitudinal yarns in the stacked pairs. The longitudinal yarn balancing transverse yarn is interwoven in a weave pattern which maintains the longitudinal yarns stacked upon one another and in general vertical alignment in the weave pattern. A fabric having increased fabric stability in the machine direction is provided yet having a high degree of openness and permeability in a range greater than thirty percent of the total fabric area.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to a woven multilayer fabric and method for a papermaking fabric and the like. In particular, the fabric has application to the dryer section of a papermaking machine wherein the fabric may be used as a support fabric or a carrier fabric. Since the details of papermaking machines are well known in the art, only so much of a papermaking machine as is necessary to an understanding of the invention will be illustrated.

Figure 1:
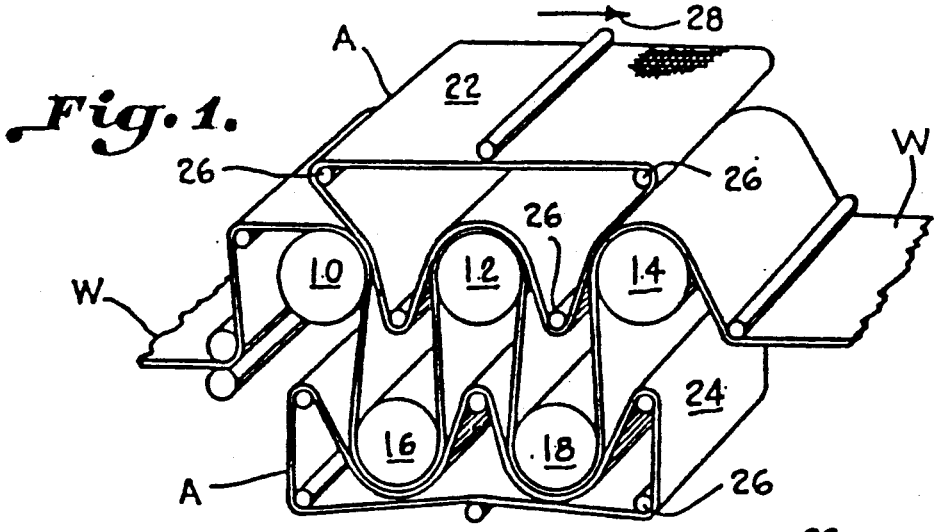
FIG. 1 is a perspective view illustrating a partial dryer section of a conventional papermaking machine utilizing a woven multilayer fabric and method in accordance with the present invention.
Figure 2:
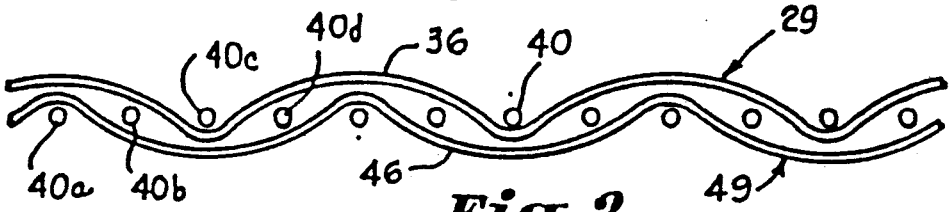
FIG. 2 is an extended sectional view as may be taken along line 2—2 of FIG. 4.

Accordingly, FIG. 1 is a simplified illustration of a portion of a dryer section of a papermaking machine wherein a continuous sheet like web W of paper stock material is traveling from left to right. In practice, several dryer sections may be utilized in succession to dry the paper in stages. Numerous different types of dryers may be utilized in a dryer section of a conventional papermaking machine, and the particular dryer illustrated in FIG. 1 is for purposes of explanation only. The dryer section includes an upper and lower array of horizontally disposed heated dryer cylinders which may be either of a perforated or imperforated construction. The upper array of heated cylinders includes cylinders 10, 12, and 14. The lower array includes cylinders 16 and 18. The continuous web W of paper is received from a press section and passed in a serpentine manner about the dryer cylinders as illustrated. Water and other fluids within the paper web are evaporated due to the paper contacting the heated cylinders. The paper web W is guided through the dryer section and held in contact with the heated cylinders by means of an upper permeable dryer fabric 22 and a lower permeable dryer fabric 24. Dryer fabrics 24 and 22 are identical in their construction, and are constructed in accordance with the fabric and method of the present invention as will be more fully explained hereafter. Since the fabrics are identical, description of the invention will be made by reference to fabric 22 only which hereinafter is referred to as fabric A. By contacting the paper web W, the dryer fabrics press and maintain the web in intimate heat transfer relationship with the dryer cylinders whereby the cylinders remove water or other fluids from the web. The drying process is outwardly from the heated cylinders through the paper web and through the dryer fabric. Thus sufficient permeability must be had in order to facilitate drying of the fabric.

The fabric is in the form of endless belts which travel over machine belt 26 rollers. The fabric travels in its endless belt configuration in a machine direction as shown in the direction of arrow 28. During the repeated travel of the fabric over the belt rollers in the machine direction, the fabric comes under considerable stress in the machine direction due to the motion of the endless travel and the heat transfer from the heated cylinders. If the fabric should stretch out of shape, its use as a paper support or carrier fabric becomes diminished to the point of uselessness.

While the above describes the use of the fabric in a conventional dryer section of a papermaking machine, the fabric has particular advantages for use in through air drying systems for tissue and towel grades of paper. In this application, the fabric is used as a carrier fabric with an embossed layer embedded in the fabric which imprints the paper web. The use of a carrier fabric and an embossed layer in a papermaking machine with a through air dryer is illustrated in European Patent Application, Publication No. 0 135 231, filed on Aug. 16, 1984.

Figure 3A:
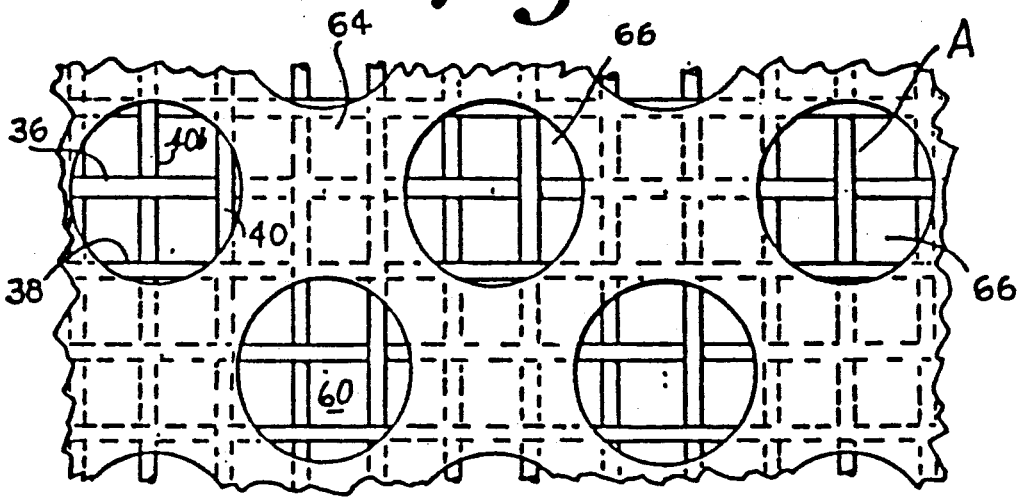
FIG. 3A is a top plan view of the fabric of FIG. 3.
Figure 3:
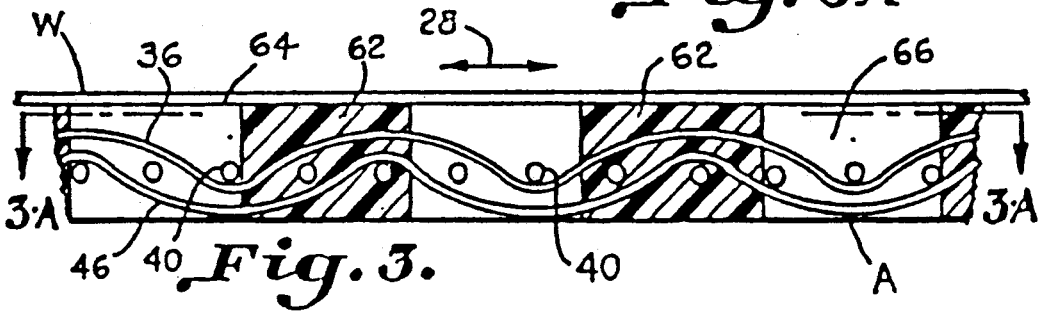
FIG. 3 is an elevation illustrating the woven multilayer fabric and method of the present invention applied as a carrier fabric.

As a base fabric, fabric permeabilities in the range of 1000 to 1200 cfm can be had in accordance with the instant invention with the increased stability in the machine direction provided by the double longitudinal yarn system, and 30 percent or more open area. The base fabric carrying a resinous embossed layer as shown in FIGS. 3 and 3A has a lower permeability but is still sufficient for drying purposes. This decrease of air permeability between the base fabric without the resinous layer and the base fabric carrying the resinous layer depends on the size, shape, and pattern of the holes in the resinous layer.

Figure 4:
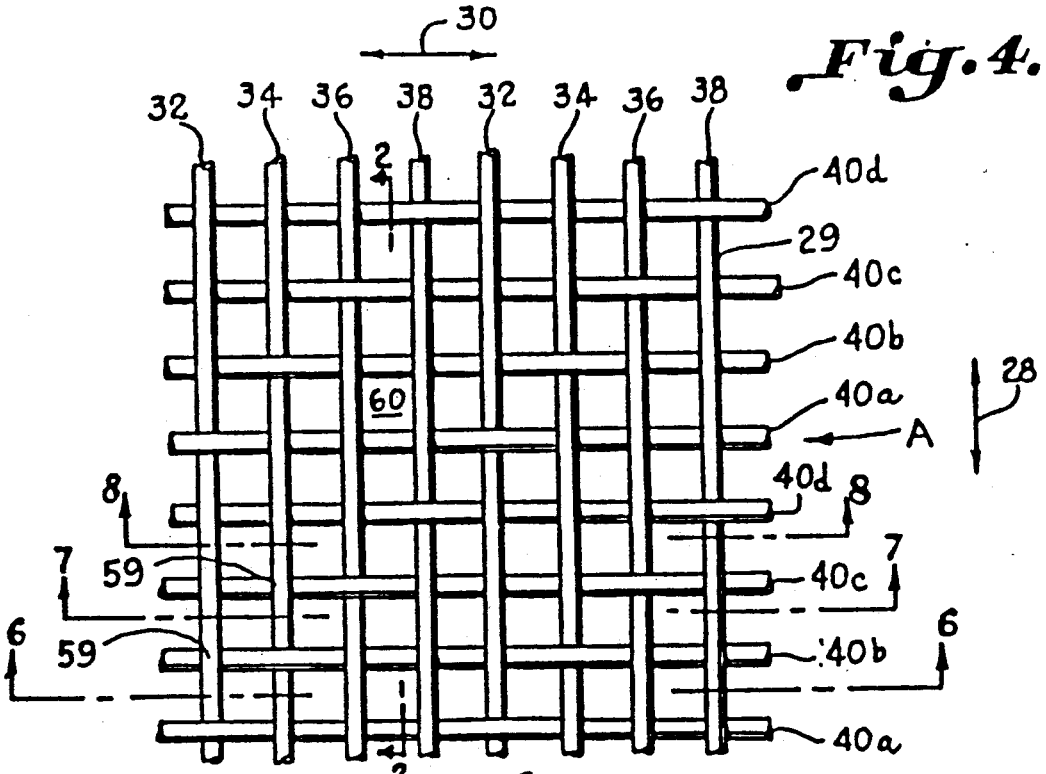
FIG. 4 is a plan view illustrating woven multilayer papermaking fabric and method in accordance with the present invention.
Figure 5:
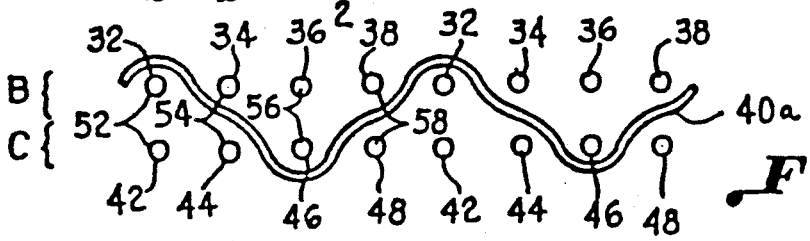
FIG. 5 is an end sectional view of the fabric of FIG. 4.

Referring now in more detail to the drawings, FIG. 4 is a top plan view from a paper support side designated generally as 29 of a fabric illustrating woven multilayer fabric A constructed in accordance with the present invention. The machine direction is indicated by the arrow 28 and the cross-machine direction is illustrated by arrow 30. It can thus be seen that a first longitudinal yarn layer B consisting of first longitudinal or machine direction yarns 32, 34, 36, and 38, repeatedly numbered across the fabric as illustrated in FIGS. 4–8, lies on the paper support side of the fabric A. The longitudinal yarns extend in the machine direction 28. The longitudinal yarns are woven in a four-shed repeat with a single transverse yarn system which consists of transverse yarns 40. The transverse yarn system 40 is woven in four transverse yarns 40*a*, 40*b*, 40*c*, and 40*d* which repeats itself.

As can best be seen in FIGS. 4–8 and 2, there is a second longitudinal yarn layer C which consists of a number of second longitudinal or machine direction yarns 42, 44, 46, and 48, repeatedly numbered across the fabric. The second longitudinal yarn layer is the roller contact side designated generally as 49 of the fabric which contacts the belt rollers 26 when traveling in the machine direction in an endless manner.

As can best be seen in FIGS. 5 through 8, the longitudinal yarns of the first longitudinal yarn layer B and the longitudinal yarns of the second longitudinal yarn layer C are stacked on top of each other. The longitudinal yarns 32 and 42 define a first stacked pair 52. The longitudinal yarns 34 and 44 define a second stacked pair 54. The longitudinal yarns 36 and 46 define a third stacked pair 56. The longitudinal yarns 38 and 48 define a fourth stacked pair 58. The longitudinal yarn balancing yarn 40 interweaves with the longitudinal yarns of the respective stacked pairs in such a manner that a balanced weave is provided wherein the longitudinal yarns, 32 and 42, for example, are maintained in their stacked configuration. The tendency of the longitudinal yarns to shift laterally in the stacked pairs is prevented by the illustrated balanced weave pattern of the transverse yarn 40.

By noting the over, between, under, between repeat pattern of the alternating transverse yarns (FIGS. 5–8) of the balancing transverse yarn system, the binding of the longitudinal yarns into vertically stacked pairs and balancing effect of the weave pattern can readily be seen. The balanced weave pattern maintains the stacked configuration of the longitudinal yarns. The cross-over point 59 of the transverse yarns is staggered in the transverse yarn direction across the longitudinal yarns as can best be seen in FIG. 4. A variation of the above balanced weave pattern can be achieved by interchanging transverse yarn 40*c* shown in FIG. 7 with transverse yarn 40*d* shown in FIG. 8. This results in a broken, staggered pattern of the cross-over points of the weave in the transverse yarns direction. In this pattern, the first two cross-over points are in a straight diagonal. The third cross-over point is shifted over a third longitudinal yarn to a fourth longitudinal yarn and then the cross-over point is shifted back in a diagonal to the third longitudinal yarn. This weave pattern also maintains the longitudinal yarns in a stacked pair in a suitably stacked configuration. However, in this weave pattern, the two longitudinal yarns pass together between two adjacent transverse yarns. In the first described balanced weave pattern, there are no two transverse yarns between which the longitudinal yarns simultaneously pass, which provides a slightly better balanced weave pattern.

Figure 6:
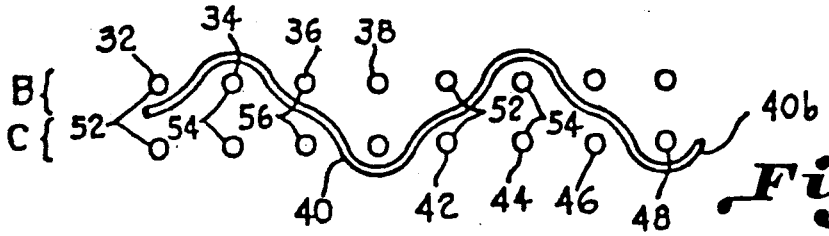
FIG. 6 is a sectional view taken along line 6—6 of FIG. 4.
Figure 7:
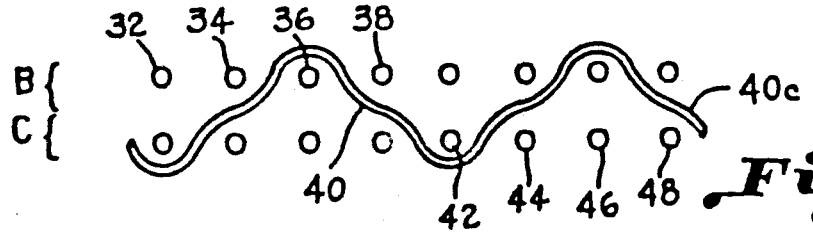
FIG. 7 is a sectional view taken along line 7—7 of FIG. 4.
Figure 8:
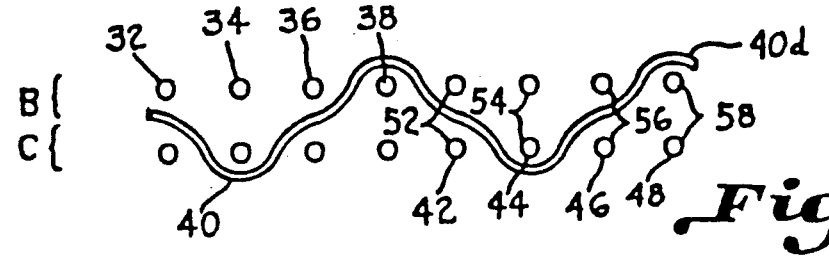
FIG. 8 is a sectional view taken along line 8—8 of FIG. 4.

The balanced weave pattern of the transverse yarn system 40 consists of a four-shed repeat pattern wherein a first transverse yarn 40*a* passes over a first stacked pair 52, between the longitudinal yarns of the second stacked pair 54, under the yarns of the third stacked pair 56, and between the yarns of the fourth stacked pair 58. In the broadest sense, the pattern passes over and under every other pair of stacked longitudinal yarns while passing between the yarns of an intermediate stacked pair disposed between every other stacked pair. By passing between the yarns after passing over and under the previous pair of stacked yarns, the tendency of the longitudinal yarns to shift laterally beside each other is substantially reduced thus maintaining the longitudinal yarns on top of each other. FIG. 6 shows the second transverse yarn 40*b* of the transverse yarn system 40. FIG. 7 illustrates the third transverse yarn 40*c*, and FIG. 8 the fourth transverse yarn 40*d*.

Referring again to FIG. 4, it can be seen that the stacked pairs of longitudinal yarns are spaced considerably in the cross-machine direction 30 so that open areas 60 are provided which provide a projected open area of thirty percent or more of the total fabric area. Since the load bearing longitudinal yarns 32 through 38 and 42 through 48 are stacked underneath each other, the effective density of load bearing longitudinal yarns is doubled without decreasing the open area of the fabric. Increased structural stability is provided in the machine direction without decrease in the permeability or open area of the fabric. This is particularly advantageous when the fabric is used as a carrier fabric for another layer 62 as can best be seen in FIG. 3. The layer 62 is typically a material such as resin having an embossed outer surface 64 which imprints a pattern upon the paper web W supported thereon. The layer 62 is perforated at 66 to allow for the flow of moisture and air therethrough. The effective permeability of the layer 62 and drying of the paper W thereon will be sufficiently provided only if the open area and permeability of the carrier fabric A is sufficient. Not only is the open area of the carrier fabric constructed in accordance with the method of the present invention adequate, but the structural stability of the fabric of the instant invention is particularly advantageous for carrying the layer 62 due to the extra loads imparted thereon in the machine direction.

Various combinations of materials and yarn diameters and shapes of yarns may be utilized in the fabric described herein. For example, the longitudinal yarn systems B and C may be of one diameter, and the transverse yarn system 40 may be of a larger diameter. This provides a stiffer transverse yarn which will place more crimp in the longitudinal yarns. This result in a decided advantage if the fabric is woven flat when the ends of the fabric are joined together in an endless manner at a seam. The crimp longitudinal yarns are more easily interwoven together in the endless fabric and interlocked at the seam. Other variations may include the longitudinal yarn system B and the transverse yarn system 40 being identical, and the longitudinal yarn system C being different either in material, diameter, or shape. Likewise, the longitudinal yarn system C and transverse yarn system 40 may be identical, with the longitudinal yarn system B being different. Furthermore, each of the longitudinal yarn system B, longitudinal yarn system C, and transverse yarn 40 can be different.

A preferred material for the construction of the fabric is polyester. However polyamid and high heat resistant materials such as Kevlar or Nomex brands, as well as other materials which are well known in a use for paper fabric manufacturing, may be utilized. At present, round, oval, and rectangular shapes may be used for the longitudinal yarns. The transverse yarn may be provided in a round shape. It may be also desirable at a later date to utilize an oval or rectangular shape in the transverse yarn.

A preferred range of yarn diameters is from 0.10 to 0.20 mm. Depending on the application, larger diameters of fibers may also be utilized. The diameter, shape, and material will be determined by the particular application being made of the fabric.

In accordance with the method of the present invention, a method of weaving a multilayered papermaking fabric A having a weave pattern which provides increased fabric stability in a machine direction and high fluid permeability includes the step of weaving the first longitudinal yarn layer B having first load bearing longitudinal yarns extending in the machine direction and weaving the second layer C having second load bearing longitudinal yarns extending in the machine direction, thus doubling the number of load bearing longitudinal yarns. Respective ones of the first and second longitudinal yarns of said first and second longitudinal yarn layers are arranged in the weave pattern to define stacked pairs of longitudinal yarns. A longitudinal yarn balancing transverse yarn is woven in a cross-machine direction with the first and second load bearing longitudinal yarns to balance and maintain the longitudinal yarns in the stacked pairs. By spacing the stacked pairs of longitudinal yarns in the cross-machine direction, a desired fabric permeability can be provided without sacrificing the increased fabric stability of the fabric in the machine direction. It has been found quite advantageous that if the transverse yarn 40 from a single transverse yarn system is woven in a four-shed repeat pattern, that the stacked configuration of the longitudinal yarns can be provided. In the four-shed repeat pattern, the transverse yarn passes over both of the yarns in a first stacked pair 52, between the longitudinal yarns of a second stacked pair 54, under both of the longitudinal yarns in a third stacked pair, and between the longitudinal yarns of a fourth stacked pair 56. This repeat pattern has been found to effectively resist the tendency of the stacked longitudinal yarns to shift relative to each other in a lateral direction, thus maintaining them in their vertical orientation on top of each other. In practice, the stacked pairs of longitudinal yarns are spaced in the cross-machine direction to provide a projected fabric open area of at least thirty percent of the total fabric area.

While the term yarn has been used throughout the application, it is to be understood that the term yarn encompasses a monofilament element as well as multifilament elements. The same is true when the term yarn is used in the plural sense.

The longitudinal and the transverse yarns are preferably synthetic monofilaments, especially polyester monofilaments, and they are preferably interwoven by a flat weaving process in order to produce the high permeable woven multilayer papermaking fabric according to the invention. With such a process, the longitudinal yarns are the warp yarns and the transverse yarn is the weft yarn. Multifilaments can, however, also be used for the longitudinal and/or transverse yarns. An endless weaving process can also be utilized so that the longitudinal yarns are the weft yarns and the transverse yarns are the warp yarns.

While a preferred embodiment of the invention has been described using specific terms, such description is for illustrative purposes only, and it is to be understood that changes and variations may be made without departing from the spirit or scope of the following claims.

What is claimed is:

1. A highly permeable woven multilayer papermaking fabric for a papermaking machine having rollers about which said papermaking fabric travels endlessly, said papermaking fabric having increased fabric stability in the machine direction which corresponds to the direction said papermaking fabric travels on said papermaking machine, the machine direction stability being attributable to the running direction of stacked yarn pairs of said woven papermaking fabric said fabric being of the type which includes a paper support side and a roller contact side facilitating travel as an endless belt in said machine direction wherein said woven fabric comprises:

a first layer of first load bearing yarns in said machine direction on said paper support side of said fabric;

a second layer of second load bearing yarns in said machine direction on said roller contact side of said fabric;

stacked pairs of said machine direction yarns defined by first and second machine direction yarns of said first and second layers arranged in a superposed position one above the other;

a yarn interwoven with said machine direction yarns of said first and second layers in the cross-machine direction thereto to maintain said machine direction yarns stacked upon one another in a weave pattern;

said stacked pairs of machine direction yarns being spaced in the cross-machine direction in said weave pattern to provide a projected open fabric area; and said projected open area of said fabric being thirty (30%) percent or more of the total fabric area.

2. The fabric of claim 1 wherein said cross-machine direction yarn is woven in a four-shed repeat pattern wherein said cross-machine direction yarn passes over both said machine direction yarns in a first stacked pair, between the machine direction yarns of a second stacked pair, under the machine direction yarns of a third stacked pair, and between the machine direction yarns of a fourth stacked pair.

3. The fabric of claim 2 wherein said cross-machine direction yarn is displaced in a cross-machine direction by one stacked pair of machine direction yarns in each repeat of said weave pattern.

4. The fabric of claim 1 including a resinous layer carried by said fabric for contacting said paper including passages facilitating flow of air through said fabric and resinous layer.

5. A method of weaving a papermaking fabric for a papermaking machine having rollers about which said fabric travels endlessly, said fabric having increased fabric stability in a machine direction which corresponds to the direction said fabric travels on said paper-making machine while having a substantial open area to provide a highly permeable fabric comprising:

weaving two layers in said machine direction, each layer consisting of load bearing machine direction yarns stacked on top of the machine direction yarns of the adjacent other layer in said fabric;

weaving a yarn in the cross-machine direction to said machine direction in a balanced weave pattern with said machine direction yarns of said layers to prevent shifting of said stacked machine direction yarns and create stacked pairs of said machine direction yarns; and spacing said stacked machine direction yarns in said cross-machine direction to provide a projected open area of about thirty (30%) percent or more of the total fabric area.

6. The method of claim 5 including weaving a first machine direction yarn in a stacked pair in a repeat pattern wherein said first machine direction yarn goes under one pass of said cross-machine direction yarn, and over the next three consecutive passes of said cross-machine direction yarn.

7. The method of claim 6 wherein the second of said machine direction yarns in said stacked pair is woven in said repeat pattern with said first machine direction yarn wherein said second machine direction yarn passes correspondingly under two passes and then over and under the next consecutive two passes of said cross-machine direction yarn.

8. The method of claim 5 including weaving said cross-machine direction yarn in a repeat pattern which includes passing over both machine direction yarns of a first stacked pair, between said machine direction yarns of a second stacked pair, under both machine direction yarns of a third stacked pair, and between said machine direction yarns of a fourth stacked pair.

9. The method of claim 8 including displacing said cross-machine direction yarn in the cross-machine direction by one pair of stacked machine direction yarns on each repeat of said repeat pattern.

* * * * *